US008882230B2

(12) United States Patent
Nonoyama et al.

(10) Patent No.: US 8,882,230 B2
(45) Date of Patent: Nov. 11, 2014

(54) LIQUID DROPLET EJECTING HEAD, INK CARTRIDGE, AND IMAGE FORMING APPARATUS

(75) Inventors: Yusuke Nonoyama, Kanagawa (JP); Kiyoshi Yamaguchi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/545,282

(22) Filed: Jul. 10, 2012

(65) Prior Publication Data

US 2013/0016152 A1 Jan. 17, 2013

(30) Foreign Application Priority Data

Jul. 14, 2011 (JP) ..... 2011-155959

(51) Int. Cl.

| | |
|---|---|
| ***B41J 29/38*** | (2006.01) |
| ***B41J 2/045*** | (2006.01) |
| ***B41J 2/14*** | (2006.01) |
| ***B41J 2/175*** | (2006.01) |

(52) U.S. Cl.

CPC ..... *B41J 2/04563* (2013.01); *B41J 2/14233* (2013.01); *B41J 2/17553* (2013.01); *B41J 2/0458* (2013.01)

USPC ..... 347/17; 347/70

(58) Field of Classification Search

CPC ..... B41J 2/04563

See application file for complete search history.

(56) References Cited

U.S. PATENT DOCUMENTS

| | | | | |
|---|---|---|---|---|
| 4,364,059 | A | 12/1982 | Nagayama | |
| 6,467,865 | B1 * | 10/2002 | Iwamura et al. | 347/14 |
| 7,445,314 | B2 * | 11/2008 | Lee et al. | 347/17 |
| 7,588,307 | B2 * | 9/2009 | Hong et al. | 347/17 |
| 8,186,810 | B2 * | 5/2012 | Akahane | 347/68 |
| 2005/0190240 | A1 * | 9/2005 | Takatsuka | 347/68 |
| 2007/0052764 | A1 * | 3/2007 | Oku | 347/68 |
| 2007/0263041 | A1 * | 11/2007 | Owaki | 347/71 |
| 2008/0062216 | A1 * | 3/2008 | Bergstedt et al. | 347/17 |
| 2008/0298427 | A1 * | 12/2008 | Gabl et al. | 374/119 |
| 2009/0002442 | A1 * | 1/2009 | Choi et al. | 347/42 |
| 2010/0013893 | A1 * | 1/2010 | Akahane | 347/65 |
| 2011/0221820 | A1 * | 9/2011 | Shibata | 347/17 |

FOREIGN PATENT DOCUMENTS

| | | |
|---|---|---|
| JP | 56-86765 | 7/1981 |
| JP | 03247457 A | * 11/1991 |
| JP | 2670083 | 7/1997 |
| JP | 10-217463 | 8/1998 |
| JP | 2010-155468 | 7/2010 |

* cited by examiner

*Primary Examiner* — Shelby Fidler

(74) *Attorney, Agent, or Firm* — Oblon, Spivak, McClelland, Maier & Neustadt, L.L.P.

(57) ABSTRACT

A liquid droplet ejecting head is disclosed, including a nozzle hole which ejects liquid droplets; an ejecting liquid chamber which is in communication with outside via the nozzle hole and which contains an ejecting liquid to be the liquid droplets; a pressure generating unit which generates pressure within the ejecting liquid chamber; a temperature detecting unit which detects temperature at a location at which is arranged a temperature measuring resistive body; and a pressure control unit which controls an output of the pressure generating unit based on detected results of the temperature detecting unit, wherein the pressure generating unit is configured to increase pressure within the ejecting liquid chamber, so that the ejecting liquid within the ejecting liquid chamber is ejected from the nozzle hole as the liquid droplets, and wherein the temperature measuring resistive body is arranged at the ejecting liquid chamber forming member.

9 Claims, 6 Drawing Sheets

LIQUID DROPLET EJECTING HEAD, INK CARTRIDGE, AND IMAGE FORMING APPARATUS

TECHNICAL FIELD

The present invention relates to a liquid droplet ejecting head such as an inkjet head which ejects liquid droplets; an ink cartridge which includes the liquid droplet ejecting head; and an image forming apparatus.

BACKGROUND ART

In recent years in which an inkjet printer (an image forming apparatus) which has installed an inkjet head (a liquid droplet ejecting head) has been highly rated for high picture quality, low price, responsiveness to high speed (able to deal with fast printers as well as slow but inexpensive printers by increasing and decreasing the number of nozzles) and popularized, a further improvement in picture quality and reliability and a further reduction in cost and size have been demanded.

An inkjet head, which includes a nozzle hole which ejects ink liquid droplets; an ejecting liquid chamber (also called a pressurizing liquid chamber, a pressure chamber, an ink flow channel, etc.) which is communicatively connected to the nozzle hole; and a pressure generating unit which generates pressure which pressurizes ink within the ejecting liquid chamber, pressurizes ink within the ejecting liquid chamber with the pressure generated in the pressure generating unit to eject the ink liquid droplets from the nozzle hole.

A pressure generating unit is known which ejects ink droplets by using an electromechanical converting element such as a piezoelectric element, etc., to deform a vibrating plate which forms a wall face of the ejecting liquid chamber.

Ink used for the inkjet head generally has a property that the viscosity changes due to a temperature change, so that an amount of ink ejected changes with temperature when ejecting pressure is constant regardless of a change in the ambient temperature. Thus, there is a problem that a recording dot diameter on a recording medium changes with temperature, and, when the ambient temperature deviates from a predetermined temperature range, good print results are not obtained, causing picture quality to degrade.

As a configuration which changes ejecting pressure depending on a change in the ambient temperature, Patent document 1 discloses a configuration which uses a material (a temperature measuring resistive body) whose resistance value changes with the ambient temperature in a part of a wire which transmits a signal for driving a piezoelectric element. For example, when the ambient temperature rises, the viscosity of ink decreases, so that ejecting pressure required for ejecting a certain amount of ink decreases. In a configuration disclosed in Patent document 1, when the ambient temperature rises, the resistance value of the temperature measuring resistive body increases, increasing a voltage drop in the wire, thereby decreasing a voltage which drives a piezoelectric element as a result. In this way, an amount of deforming of a piezoelectric element to which a voltage is applied decreases and an ejecting pressure also decreases. In other words, in the configuration in Patent document 1, for a higher temperature environment in which the viscosity of ink decreases and required ejecting pressure decreases the ejecting pressure may be made lower and for a lower temperature environment in which the viscosity of ink increases and required ejecting pressure increases the ejecting pressure may be made higher.

However, with the configuration disclosed in Patent document 1, an amount of change in ejecting pressure required due to a change in the viscosity of ink with a change in temperature and an amount of change in ejecting pressure of a piezoelectric element due to a resistance value of the temperature-measuring resistive body with a change in temperature do not necessarily match. Then, it is very difficult to cause the amount of change in the ejecting pressure required with the change in temperature and the amount of change in the ejecting pressure of the piezoelectric element to match in all ambient temperature areas.

As different configurations which change the ejecting pressure depending on a change in the ambient temperature, Patent documents 2 and 3 disclose a configuration including a temperature detecting unit in which a voltage is applied to a temperature measuring resistive body (a thermistor) and a change in a resistance value therein is measured to detect a temperature at a location at which the temperature measuring resistive body is arranged; and a pressure control unit which controls an output of a pressure generating unit such as a piezoelectric element, etc., based on detected results of the temperature detecting unit.

In such configurations, information on the resistance value of the temperature measuring resistive body and on an output value of the pressure generating unit that is suitable at a temperature corresponding to the resistance value is input in advance into a data table included by the pressure control unit. Then, an output of the pressure generating unit is controlled based on information in the data table.

Such configurations make it possible for the pressure generating unit to output ejecting pressure required in the respective temperatures when ejecting pressure required changes due to a temperature change.

PATENT DOCUMENTS

Patent document 1: JP10-217463A
Patent document 2: JP2670083B
Patent Document 3: JP2010-155468A In the inkjet head disclosed in Patent documents 2 and 3, a temperature measuring resistive body is arranged at a member which is different from an ejecting liquid chamber forming member which forms an ejecting liquid chamber containing ink that has pressure applied by a pressure generating unit. If only a temperature of an installed environment is taken into account, there seems to be no problem with temperature detection regardless of where within the inkjet head the temperature measuring resistive body is arranged.

However, the temperature measuring resistive body is a resistive body whose resistance changes with temperature; when voltage is applied thereto, it generates heat due to Joule heating. Therefore, due to the voltage application over time, the temperature of the member in which the temperature measuring resistive body is arranged rises relative to that of the other members which make up the inkjet head. Then, in the configuration in which the temperature measuring resistive body is arranged at a member different from the ejecting liquid chamber, the temperature measuring resistive body and the member at which it is arranged rise in temperature; however, the ejecting liquid chamber forming member and ink within the ejecting liquid chamber formed at the ejecting liquid chamber forming member are difficult to be heated by heat generation of the temperature measuring resistive body, so that rise in temperature of ink within the ejecting liquid chamber depending on rise in temperature of the temperature measuring resistive body is unlikely to occur. In this way, a temperature difference is caused between a temperature at a location at which the temperature measuring resistive body is arranged and a temperature of ink within the ejecting liquid chamber, possibly causing a case such that an ejecting pressure output by the pressure generating unit based on measured results of the temperature measuring resistive body and an ejecting pressure output by the pressure generating unit based on measurement results of the temperature measuring resistive body. In this case, a temperature difference between a temperature of a location at which a temperature-measuring resistive body is arranged and a temperature of ink within the ejecting liquid chamber leads to a change in an amount of liquid droplets ejected and an inability to obtain a stable ink liquid droplet ejection characteristic.

For a failure in which the temperature difference between the temperature of the location at which the temperature-measuring resistive body is arranged and the temperature of a liquid within the ejecting liquid chamber leads to an inability to obtain a stable liquid droplet ejection characteristic, the liquid ejected is not limited to ink. A similar problem may occur for any device that ejects liquid whose viscosity changes with temperature.

DISCLOSURE OF THE INVENTION

In view of the above problems as described above, an object of the present invention is to provide, with a configuration which controls ejecting pressure based on a temperature detected using a temperature measuring resistive body, a liquid droplet ejecting head which makes it possible to obtain stable liquid droplet ejecting characteristics; an ink cartridge which is provided with the liquid droplet ejecting head; and an image forming apparatus.

According to an embodiment of the present invention, a liquid droplet ejecting head which is configured by overlaying and fixing a nozzle plate which is provided with a nozzle hole; and an ejecting liquid chamber forming member which makes up a wall face forming an ejecting liquid chamber is provided, the liquid droplet ejecting head including the nozzle hole which ejects liquid droplets; the ejecting liquid chamber which is in communication with outside via the nozzle hole and which contains an ejecting liquid to be the liquid droplets; a pressure generating unit which generates pressure within the ejecting liquid chamber; a temperature detecting unit which detects temperature at a location at which is arranged a temperature measuring resistive body; and a pressure control unit which controls an output of the pressure generating unit based on detected results of the temperature detecting unit, wherein the pressure generating unit is configured to increase pressure within the ejecting liquid chamber, so that the ejecting liquid within the ejecting liquid chamber is ejected from the nozzle hole as the liquid droplets, and wherein the temperature measuring resistive body is arranged at the ejecting liquid chamber forming member.

According to the present invention, a temperature measuring resistive body is arranged at an ejecting liquid chamber forming member at which an ejecting liquid chamber is formed, so that the temperature measuring resistive body and the ejecting liquid chamber forming member at which the temperature measuring resistive body is arranged rise in temperature due to heat generation of the temperature measuring resistive body. Thus, as the ejecting liquid chamber forming member rises in temperature with the temperature measuring resistive body, it becomes likely for ink within the ejecting liquid chamber formed at the ejecting liquid chamber forming member to heat up. Thus, it becomes likely for a temperature rise to occur in the ink within the ejecting liquid chamber in response to a temperature rise in the temperature measuring resistive body. This prevents causing a temperature difference to occur between a temperature at a location at which the temperature measuring resistive body is arranged and a temperature of the ink within the ejecting liquid chamber, increasing a likelihood for an ejecting pressure output by the pressure generating unit based on results of measurement by the temperature measuring resistive body and an ejecting pressure needed that changed due to the temperature change to match. This makes it possible to prevent an amount of liquid droplets ejected from changing due to the temperature difference between the temperature at the location at which the temperature measuring resistive body is arranged and the temperature of the ink within the ejecting liquid chamber.

The present invention, which makes it possible to prevent an amount of liquid droplets ejected from changing, has an excellent advantage of being able to obtain a stable liquid droplet ejection characteristic.

BRIEF DESCRIPTION OF THE DRAWINGS

Other objects, features, and advantages of the present invention will become more apparent from the following detailed descriptions when read in conjunction with the accompanying drawings, in which.

BEST MODE FOR CARRYING OUT THE INVENTION

Below an inkjet printer (below, a printer 100) is explained as one embodiment of the image forming apparatus to which the present invention can be applied.

Figure 1:
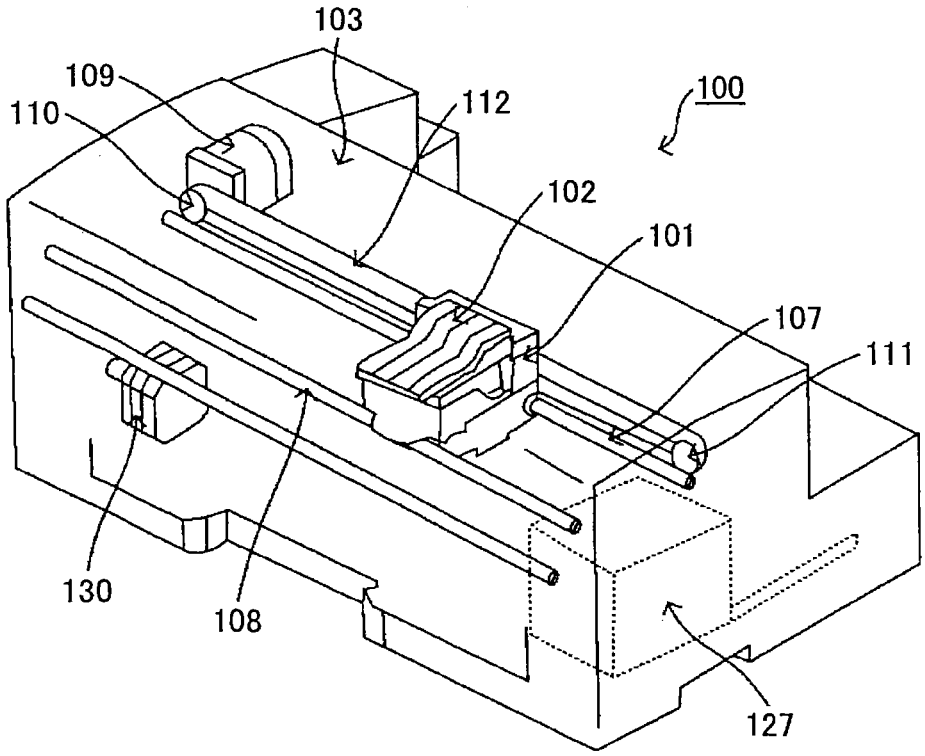
FIG. 1 is a schematic perspective view of an inkjet printer.

First, the basic configuration of the printer 100 is described. FIG. 1 is a perspective view of the printer 100. The printer 100 has inside a body thereof a print machinery unit 103 which includes an ink cartridge 102, a recording head 51, and a carriage 101. The carriage 101 is a member which is moveable in a scanning direction, which is a direction orthogonal to a conveying direction of a sheet 30. The recording head 51 is an inkjet head as an example of a liquid droplet ejecting head installed at the carriage 101; and the ink cartridge 102 supplies ink liquid to the below-described recording head 51.

Figure 2:
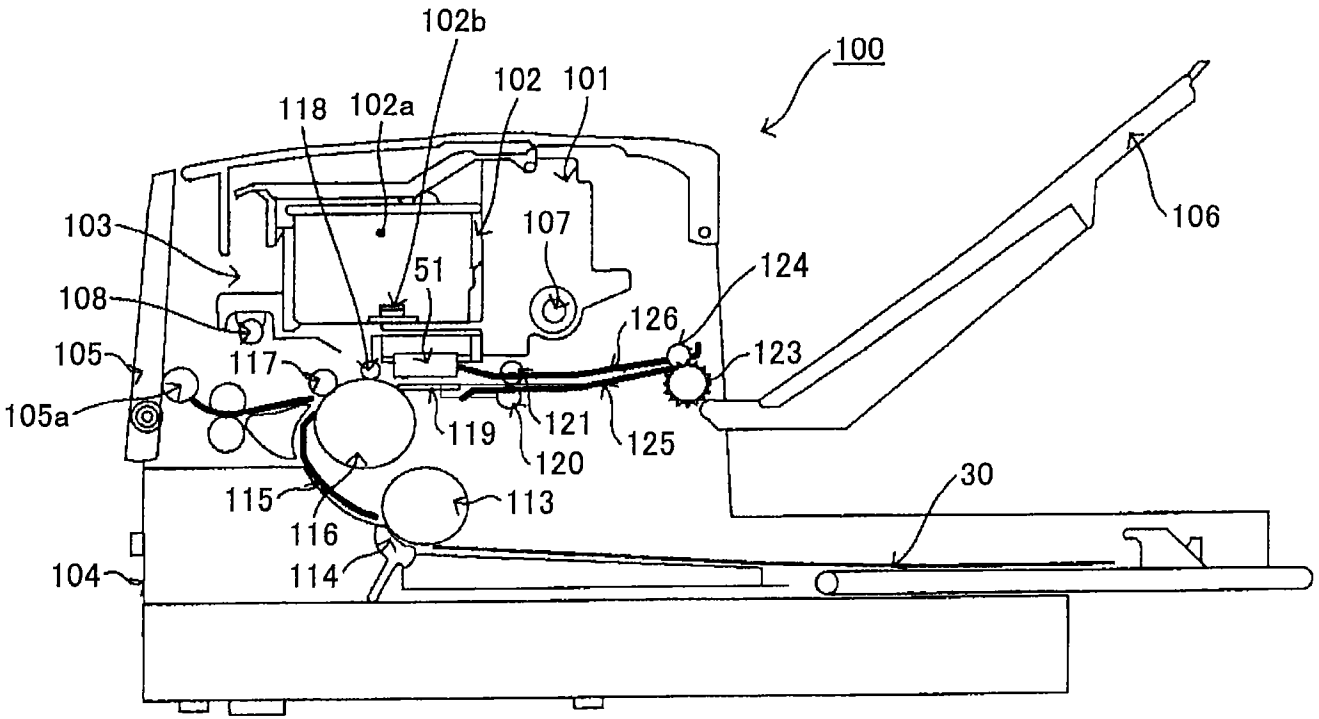
FIG. 2 is a schematic cross sectional view of the inkjet printer.

FIG. 2 is a schematic cross-sectional diagram in the ink cartridge 102 portion when viewed from a front side in FIG. 1 in a main scanning direction of the printer 100. As shown in FIG. 2, inside the body of the printer 100 are included the print machinery unit 103 and a paper-feeding machinery unit 104.

While details are described below, in the printer 100, the sheet 30 fed from a paper-feeding tray or a manual tray 105 is taken in, required images are recorded by the print machinery unit 103, after which the sheet is discharged onto a paper-discharging tray 106 mounted on the back face side.

The carriage 101 of the print machinery unit 103 has replaceably mounted four of the ink cartridges 102 which contain ink liquid of corresponding colors of yellow (Y); magenta (M); cyan (C); and black (B).

Figure 3:
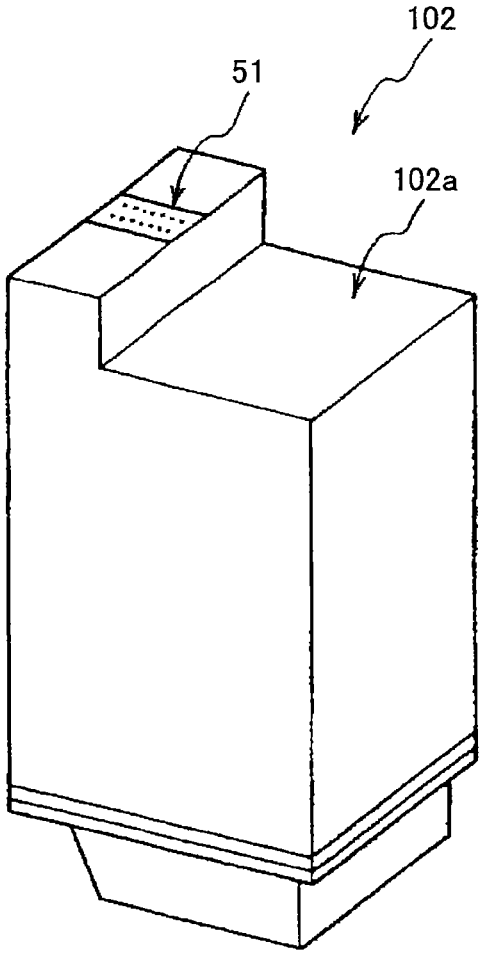
FIG. 3 is a schematic configuration diagram of an ink cartridge.

FIG. 3 is a schematic configuration diagram of one of the four ink cartridges 102. The four ink cartridges 102 have a similar configuration except that the colors of ink liquids contained differ. The ink cartridge 102 mounted on the carriage 101 includes the recording head 51 which has plural nozzle holes; and a tank unit 102*a* which supplies ink to the recording head 51. Here, in FIG. 3, the recording head 51, which is provided such that it faces down in FIG. 1 or 2, is drawn to face up for purposes of explanations.

At an upper portion of the tank unit 102*a* of the ink cartridge 102 (at an upper portion in FIG. 2) is provided an atmospheric port (not shown) which is in communication with atmosphere. Moreover, as shown in FIG. 2, at a lower portion of the tank 102*a* is provided a supplying port 102*b* which supplies ink liquid within the tank 102*a* to the recording head 51. Moreover, inside the tank 102*a* is included a multiporous material (not shown) which is filled with the ink liquid, a capillary force of which multiporous material maintains the ink liquid supplied to the recording head 51 at a slightly negative pressure.

The recording head 51 has multiple nozzle holes, which are ink ejecting ports, aligned in a direction which crosses the main scanning direction, and is arranged such that the ink liquid droplet ejecting direction corresponds to a lower portion.

In the present embodiment, while the cartridge 102 is explained in which the recording head 51 and the tank 102*a* are integrated, the tank 102*a* and the recording head 51 may be made separate. Moreover, while heads corresponding to respective colors are used here as the recording head 51, it may be one head which has nozzle holes ejecting ink liquid of the respective colors.

As a holding unit which holds the carriage 101, the print machinery unit 103 includes a main guiding rod 107 which is laterally bridged across both side faces in the main scanning direction of the printer 100 body and which penetrates the back side (the downstream side in a sheet conveying direction) of the carriage 101. Moreover, it includes a sub guiding rod 108 which extends parallel to the main guiding rod 107 at a certain gap, and on which the front side (the upstream side in the sheet conveying direction) of the carriage 101 is placed. The carriage 101 is slidably held by the main guiding rod 107 and the sub guiding rod 108 such that it is moveable in the main scanning direction.

Moreover, as a moving unit which moves the carriage 101 to scan in the main scanning direction, the print machinery unit 103 includes a timing belt 112; a drive pulley 110 and a sub pulley 111 across which the timing belt 112 is bridged; and a main scanning motor 109 which rotationally drives the drive pulley 110. As shown in FIG. 1, the drive pulley 110 is arranged on the side of one face of the printer 100 body, while the sub pulley 111 is arranged on the side of the other face of the body, so that the timing belt 112 extends parallel to the main scanning direction. Moreover, the carriage 101 is fixed to the timing belt 112.

The main scanning motor 109 is a drive source for rotating the drive pulley 110 in normal and reverse directions; when the drive pulley 110 rotates, the timing belt 112 endlessly moves in the main scanning direction. As the carriage 101 is fixed to the timing belt 112, it moves with the timing belt 112 in the main scanning direction. Therefore, the drive pulley 110 is rotated in normal and reverse directions with the main scanning motor 109, so that the carriage 101 is moved both ways in a main scanning direction.

The paper-feeding machinery unit 104 includes a paper-feeding tray on which multiple of the sheets 30 are loaded; a paper-feeding roller 113; a friction pad 114; a guiding member 115; and a conveying roller 116. The paper-feeding tray of the paper-feeding machinery unit 104, on which the multiple sheets 30 are loaded, is detachably mounted on the printer 100 body.

The paper-feeding roller 113 and the friction pad 114 separate and feed a topmost sheet of the sheets 30 set in the paper-feeding tray in order to convey the sheet 30 below the recording head 51. The guiding member 115 guides the sheet 30 separated and fed from the paper-feeding tray to an area to which it is conveyed with the conveying roller 116.

The conveying roller 116 reverses the front and back of the sheet 30 to convey it to a location which opposes the recording head 51 as a liquid droplet ejecting head. Moreover, surrounding the conveying roller 116 is arranged a conveying roller 117 which presses the sheet onto the conveying roller 116; and a tip roller 118 which sends out the sheet 30 to a location which opposes the recording head 51 at a predetermined sending out angle. The conveying roller 116, to which rotational driving is transmitted via a row of gears by a sub-scanning motor 130, rotates in a clockwise direction in FIG. 2.

There is provided an image receiving member 119, which is a sheet guiding member which guides, on the lower side of the recording head 51, the sheet 30 sent out from the conveying roller 116 in correspondence with a moving range of the carriage 101 in the main scanning direction. On the downstream side of the image receiving member 119 in the sheet conveying direction is arranged a discharging roller 120 for sending out the sheet 30 in a discharging direction; and a discharging spur 121 which opposes the discharging roller 120. Moreover, there is provided a paper-discharging roller 123 which discharges the sheet 30 sent out to the paper-discharging tray 106; and a paper-discharging spur 124 which opposes the paper-discharging roller 123. Furthermore, a lower guiding member 125 and an upper guiding member 126 are provided between the discharging roller 120 and the paper-discharging roller 123 as a pair of guiding members which forms a paper-discharging path.

Moreover, the printer 100 is provided with a manual tray 105 so as to make it possible to manually feed the sheet 30 such that it can be opened and put down relative to the printer 100 body. The sheet 30 on the manual tray 105 is conveyed to the conveying roller 116 by a manual paper-feeding roller 105*a*.

Furthermore, a recovery apparatus 127 for recovering from an ejection failure of the recording head 51 is arranged at a location which deviates from a recording area on the end of the right front side in FIG. 1 that is one end with respect to a moving direction of the carriage 101 in the print machinery unit 103. The recovery apparatus 127 has a cap unit, an absorption unit, and a cleaning unit. During the time of waiting for a print, the carriage 101 is moved to the recovery apparatus 127 side to have the recording head 51 capped with a capping unit (not shown), preventing an ejection failure due to drying of ink by maintaining nozzle holes in a wet state. Moreover, the carriage 101 is moved to a location which opposes the recovery apparatus 127 in the middle of recording, etc., and ink liquid which is not involved in recording is ejected, so that the ink viscosities of all nozzle holes are made constant, maintaining a stable ejecting performance.

If an ejection failure, etc., occur, the nozzle holes of the recording head 51 are sealed with a capping unit, and an air bubble, etc., are drawn out with ink liquid from the nozzle holes with the absorption unit through a tube (not shown)

provided at the capping unit. Then, the ink liquid and dust, etc., that are attached to a head face on which the nozzle holes are opened are removed by the cleaning unit, so that the ejection failure is recovered from. Moreover, the adsorbed ink liquid is discharged to a waste ink tank (not shown) provided at a lower portion of the printer 100 body, and is absorbed and held in an ink absorbing body within the waste ink tank.

Now, a printing operation of the printer 100 is described.

The printer 100, to which a signal such as image information is sent from an external apparatus such as a personal computer, etc., executes a printing operation. When the printing operation is executed, first the sheet 30 is fed by the manual paper-feeding roller 105*a* from the manual tray 105 or by the sheet-feeding roller 113 from the sheet-feeding tray. The sheet 30 fed from the sheet-feeding tray is guided to the guiding member 115 and the conveying roller 117, so that the front and the back of the sheet 30 are reversed while being conveyed by the conveying roller 116 and the sheet 30 is conveyed to a location which opposes the recording head 51. On the other hand, the sheet 30 supplied from the manual tray 105 is guided to the conveying roller 117, so that it is conveyed to the conveying roller 116 to be conveyed to a location opposing the recording head 51.

When the sheet conveyed to the location opposing the recording head 51 reaches a predetermined position, the conveying roller 116 is stopped, so that a movement of the sheet 30 is stopped. Then, the carriage 101 ejects predetermined ink liquid to a predetermined location of the stopped sheet 30 while moving both ways in the main scanning direction in response to an image signal to form an image corresponding to one line onto the sheet 30. Here, the one line refers to a range in a sub-scanning direction (a moving direction of the sheet 30 at a location opposing the recording head 51), over which range the recording head 51 can record onto the sheet 30.

When forming in the main scanning direction of the image corresponding to the one line is completed, the conveying roller 116 is driven for a predetermined time, and the sheet 30 is moved over what corresponds to one line in the sheet-discharging tray 106 direction. Then, the carriage 101 forms an image corresponding to one line while moving both ways in the main scanning direction in response to the image signal.

Repeating such steps for a predetermined number of times, a desired image is printed onto the sheet 30. The sheet 30 onto which the desired image is printed is conveyed by the discharging roller 120 and the discharging spur 121 and the sheet-discharging roller 123 and the sheet-discharging spur 124 and is discharged onto the paper-discharging tray 106. The carriage 101 which completed image forming moves to a location opposing the recovery apparatus 127 on the right front side in FIG. 1 to cap the nozzle holes of the recording head 51 with the capping unit (not shown).

Next, the recording head 51 is described.

Figure 4:
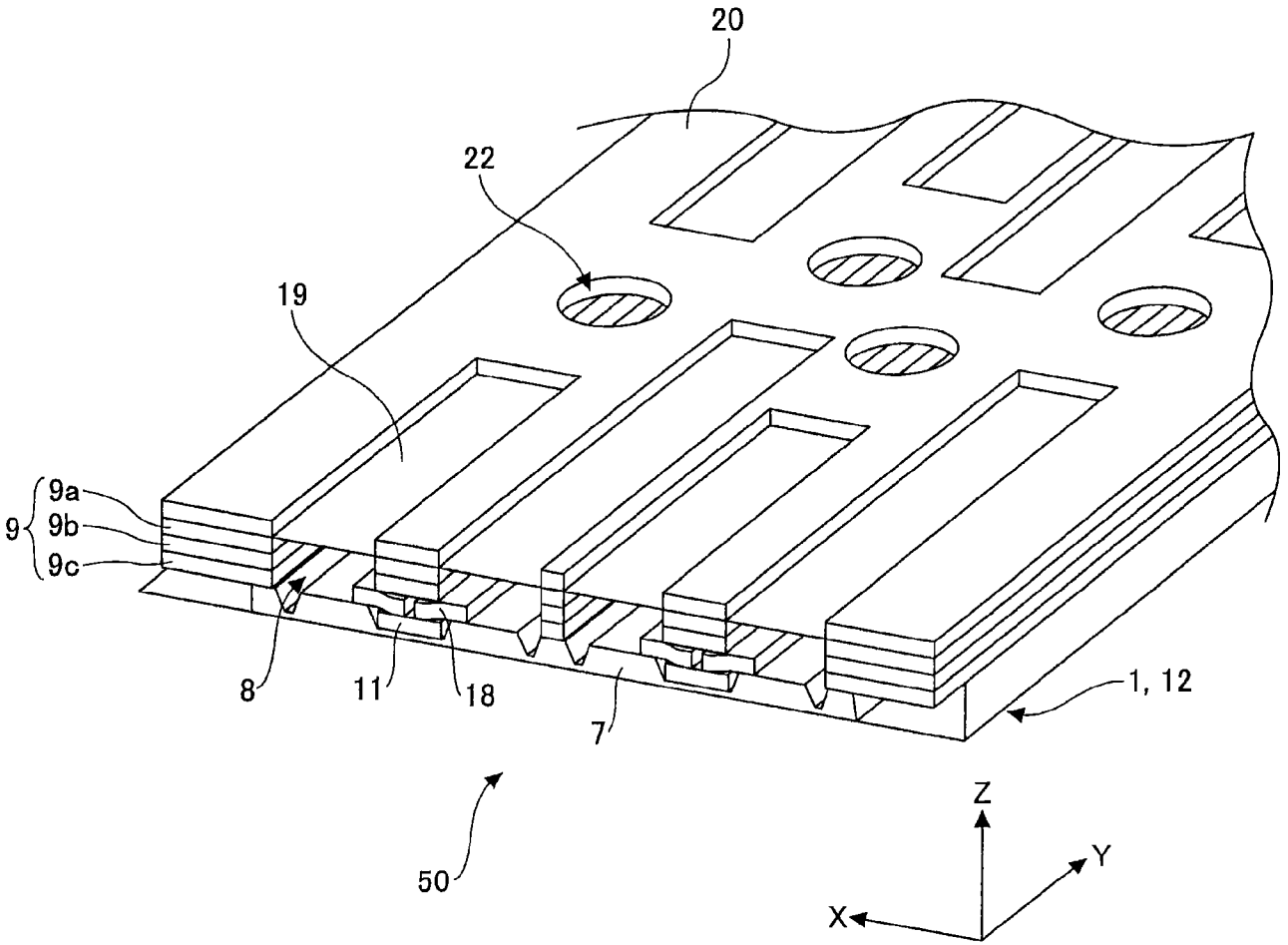
FIG. 4 is a perspective view of an upper layer of a liquid droplet ejecting head according to the present embodiment.

FIG. 4 is a perspective view of an upper layer of a liquid droplet ejecting head 50 according to the present embodiment that can be applied to the above-described recording head 51.

Figure 5A:
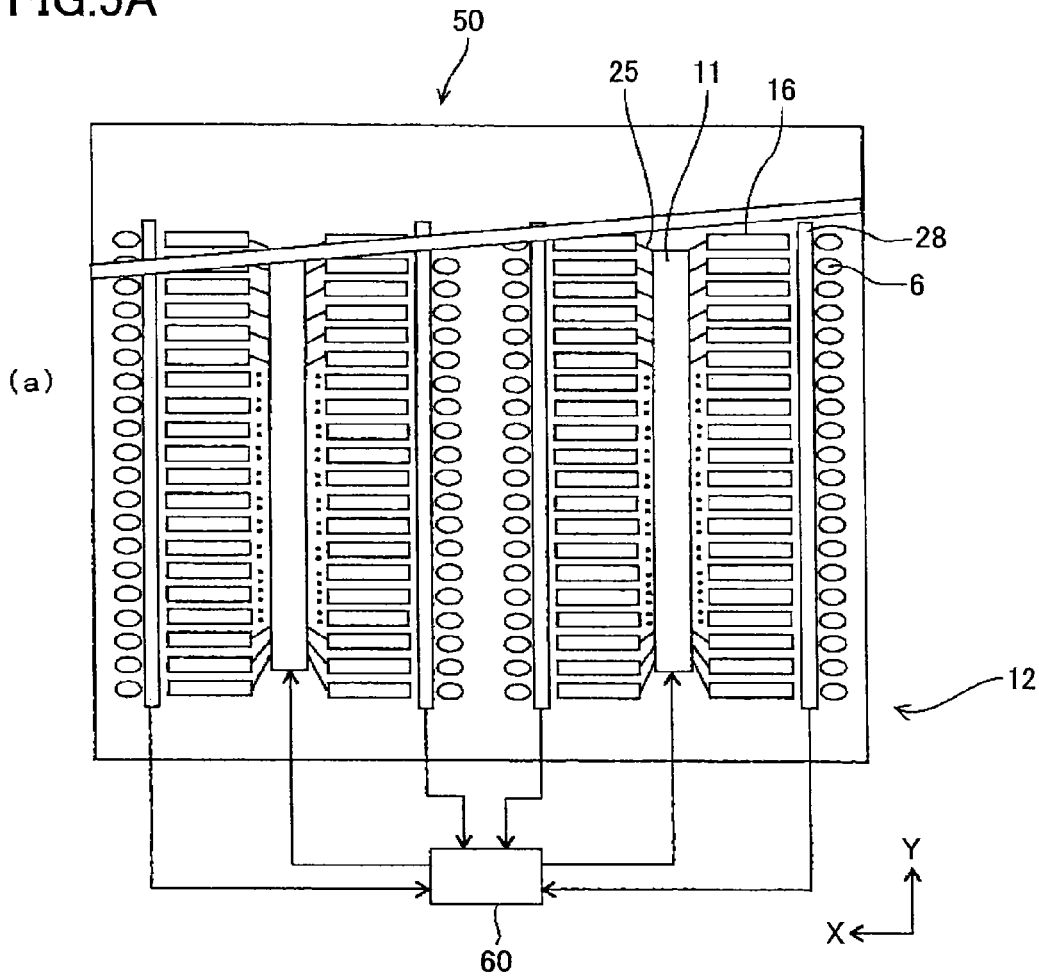
FIG. 5A is a top view for explaining a lower layer of the liquid droplet ejecting head.
Figure 5B:
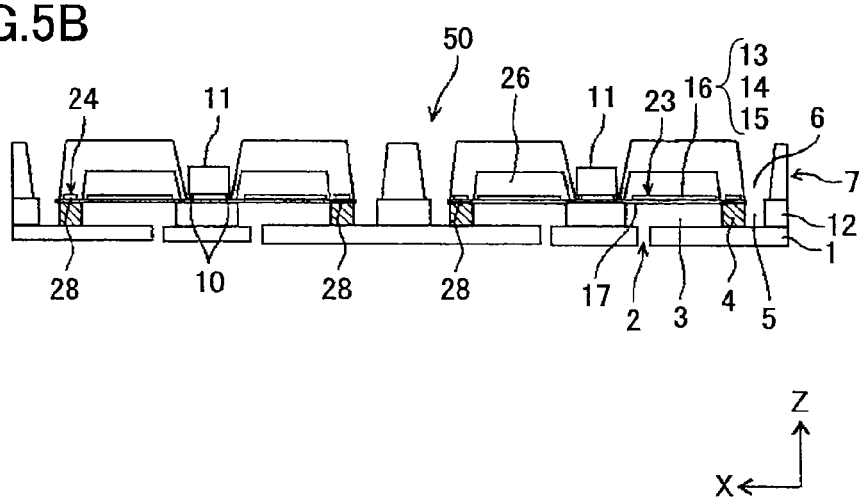
FIG. 5B is a cross-sectional view for explaining the lower layer of the liquid droplet ejecting head.

FIG. 5A and FIG. 5B are diagrams for explaining the lower layer of the liquid droplet ejecting head 50. FIG. 5A, which is a view in an X-Y plane of the lower layer from below the upper layer shown in FIG. 4, is an explanatory diagram which omits an illustration in the vicinity of the lower end of a below-described liquid supplying substrate 7. Moreover, FIG. 5B, which is a cross-sectional view in an X-Z plane of the lower layer of the liquid droplet ejecting head 50, is a cross-sectional view showing a part which is lower with respect to the below-described liquid supplying substrate 7.

The liquid droplet ejecting head 50 of the present embodiment is illustrated as an example of a side shooter scheme in which ink liquid droplets are ejected from a nozzle hole 2 provided on a face of a nozzle substrate 1. An ink system, which is divided into four parts, is a four-color integrated head in which ink of four colors can be ejected from one head.

The liquid droplet ejecting head 50 is configured with the nozzle substrate 1; a dedicated liquid chamber substrate 12; the liquid supplying substrate 7; and a frame substrate 9 being overlaid.

As shown in FIG. 5B, at the dedicated liquid chamber substrate 12, a set of a piezoelectric element 16 and a vibrating plate 17 is arranged at an upper portion of one pressure chamber 3, and one of the nozzle holes 2 is formed on a nozzle substrate 1 which makes up a lower portion of the one pressure chamber 3.

Therefore, below the multiple piezoelectric elements 16 in FIG. 5A are formed the corresponding pressure chambers 3 and respective nozzle holes 2 at lower portions thereof. In other words, at the dedicated liquid chamber substrate 12, four columns of pressure chambers 3 are arranged in the X direction; in each of these columns of pressure chambers 3 are arranged multiple pressure chambers 3 such that they are aligned in a straight line shape in the Y direction. Moreover, similarly for the nozzle substrate 1, four columns of nozzles are arranged in the X direction; in each of these columns of nozzles are arranged multiple nozzle holes 2 such that they are aligned in a straight line shape in the Y direction.

The piezoelectric element 16 includes a common electrode 13; a piezoelectric material 14; and an upper electrode 15.

At the dedicated liquid chamber substrate 12, the pressure chamber 3, the vibrating plate 17, and the piezoelectric element 16 are arranged at a location corresponding to each of the nozzle holes 2. A bump 10, which is a connecting pad, is arranged for connecting a driving integrated circuit (below called "a driving IC 11") via a lead wire 25 from the piezoelectric element 16.

As shown in FIG. 5B, at the dedicated liquid chamber substrate 12, the pressure chamber 3 is formed on a face which joins the nozzle substrate 1 (a lower face in FIG. 5B) and the piezoelectric element 16, the lead wire 25, the bump 10, and the driving IC 11 are arranged on a face (an upper face in FIG. 5B) which joins the liquid supplying substrate 7. Moreover, a temperature measuring resistive body 28 is arranged at a portion of a location of a lower face of the liquid supplying substrate 7 which joins the liquid supplying substrate 7 to the dedicated liquid chamber substrate 12.

Furthermore, the dedicated liquid chamber substrate 12 includes an insulating film 23 as an insulating body which covers an upper face of the piezoelectric element 16 and an interlayer insulating film 24 as an insulating body which covers an electrode such as the temperature measuring resistive body 28.

The liquid supplying substrate 7 has a dedicated ink supplying port 6 which supplies liquid to the dedicated liquid chamber substrate 12.

The frame substrate 9 is formed by a first frame layer 9*a*; a second frame layer 9*b*; and a third frame layer 9*c* overlaid over one another and pasted together. When the layer thickness is too large, piercing in which a common liquid chamber 8 with a desired accuracy cannot be formed for the first frame layer 9*a* and the second frame layer 9*b*, so that the liquid droplet ejecting head 50 of the present embodiment adopts a process of pasting together after processing the first frame layer 9*a* and the second frame layer 9*b* as different layers. Moreover, a part of the third frame layer 9*c* functions as an elastic member 18 which energizes an upper face of the driving IC 11 in a downward direction.

An upper face of the first frame layer 9*a* at the top of the frame substrate 9 is pasted together with a lower face of a reinforcing plate 20, while a lower face of the third frame layer 9*c* at the bottom of the frame substrate 9 is pasted together with an upper face of the liquid supplying substrate 7.

Moreover, a portion which overlaps an upper face of the liquid supplying substrate 7 at a lower face of the third frame layer 9*c* is pasted together with an upper face of the liquid supplying substrate 7, while a portion of an upper face at which the drive IC 11 is arranged below the third frame layer 9*c* is pasted together with a portion of a lower face of the second frame layer 9*b*. Moreover, a center of a portion at which the driving IC 11 is arranged below the third frame layer 9*c*, which is not connected, is a free end. In this way, an elastic member 18 is formed with a portion at which the driving IC 11 is arranged below the third frame layer 9*c* being a cantilever beam structure with a portion to which it is pasted together with the liquid supplying substrate 7 and the second frame layer 9*b* being a fixed end and a center thereof being a free end. The free end of the cantilever beam structure of the elastic member 18 is in contact with an upper face of the driving IC 11, thereby energizing the driving IC 11 downward with an elastic force. In this way, accuracy error of installation accuracy and member accuracy may be absorbed and the driving IC 11 may be fixed to the dedicated liquid chamber substrate 12.

The upper portion of the common liquid chamber 8 is blocked with a damper film 19. The damper film 19 is a film which serves a function of easing pressure (a damper) in the common liquid chamber 8.

Moreover, the reinforcing plate 20 which is formed such that a location which opposes the common liquid chamber 8 becomes an opening is arranged at an upper portion of the damper film 19. The reinforcing plate 20 reinforces bending of the damper film 19, thereby securing a moveable area of the damper film 19.

Moreover, the reinforcing plate 20 has a common ink supplying port 22 which supplies liquid to the common liquid chamber 8.

The liquid droplet ejecting head 50 includes a controller 60 which functions as a driving voltage controller which controls an output of the driving IC 11. The arrangement of the controller 60 is not limited to a configuration which is arranged in a housing of the liquid droplet ejecting head 50, so that it may be a configuration which is arranged within the ink cartridge 102, within the carriage 101, or within the printer 100 at a location which does not move with the carriage 101.

The driving IC 11 applies voltage to the piezoelectric element 16 via the bump 10 and the lead wire 25 as a wiring member.

The driving IC 11 has a function of selectively supplying a voltage supplied from the controller 60 to the piezoelectric element 16 based on the print pattern. At the same time, it has formed an A/D converting circuit and a correcting circuit that are connected to the temperature measuring resistive body 28, which is a temperature sensing unit, so that temperature information digitized in the A/D converting circuit is transmitted to the controller 60 and a driving voltage corresponding to a predetermined temperature is supplied to the piezoelectric element 16.

Such a configuration makes it possible to control an output of the piezoelectric element 16 based on a temperature sensed with the temperature measuring resistive body 28. Therefore, even when the temperature of ink within the pressure chamber 3 changes due to a change in ambient temperature and Joule heat of the temperature resistive body 28 and the piezoelectric element 16, so that the viscosity changes, ejection pressure needed at each temperature may be output by the piezoelectric element 16.

As a correcting circuit for precisely measuring the temperature, 2/3/4 conductive wire temperature measuring circuits are used. As such a correcting circuit and an A/D converting circuit are installed in the driving IC 11, signal transmission beyond the A/D converting circuit becomes a digital signal, so that measurement accuracy of temperature is not undermined no matter how long the wire becomes, making it possible to stabilize the ejection characteristics as a result. This leads to improvement in picture quality of the printer 100.

Moreover, the temperature measuring resistive body 28 is arranged such that it extends in the Y direction along the pressure chamber column. As shown in FIG. 5A, a large number of piezoelectric elements 16, which are actuators, are arranged in a direction along the pressure chamber column. Then, when the print is conducted, as there are driving channels and non-driving channels, distribution of heat generation occurs, so that distribution of temperature (unevenness of temperature) occurs in a direction along the pressure chamber column.

Here, with a configuration in which the temperature measuring resistive body 28 is arranged such that it extends in the Y direction, distribution occurs in a resistance value of the temperature measuring resistive body 28 depending on temperature. The resistance value of the temperature measuring resistive body 28 which has resistance distribution which correlates with the temperature distribution may be calculated for a unit length to determine an average temperature of the pressure chamber column.

In this way, by determining the average temperature of the pressure chamber column, rather than measuring temperature separately for each pressure chamber 3 and averaging the measured results, a temperature may be detected as a resistance value for a unit length of the temperature measuring resistive body 28 to efficiently select a driving voltage which is applied to the piezoelectric element 16 by the driving IC 11.

Moreover, as shown in FIG. 5A, at the dedicated liquid chamber substrate 12, four columns of pressure chambers 3 are arranged in the X direction, so that multiple pressure chambers 3 are arranged in the Y direction, and the dedicated liquid chamber substrate 12 includes four temperature measuring resistive bodies 28 corresponding to the respective four pressure chamber columns. In this way, a value of the driving voltage to be applied to the piezoelectric element 16 by the driving IC 11 for each column according to the distribution of the temperature may be selected, so that the ejecting characteristic may be stabilized even when a temperature distribution occurs in the X direction of the dedicated liquid chamber substrate 12.

Figure 6:
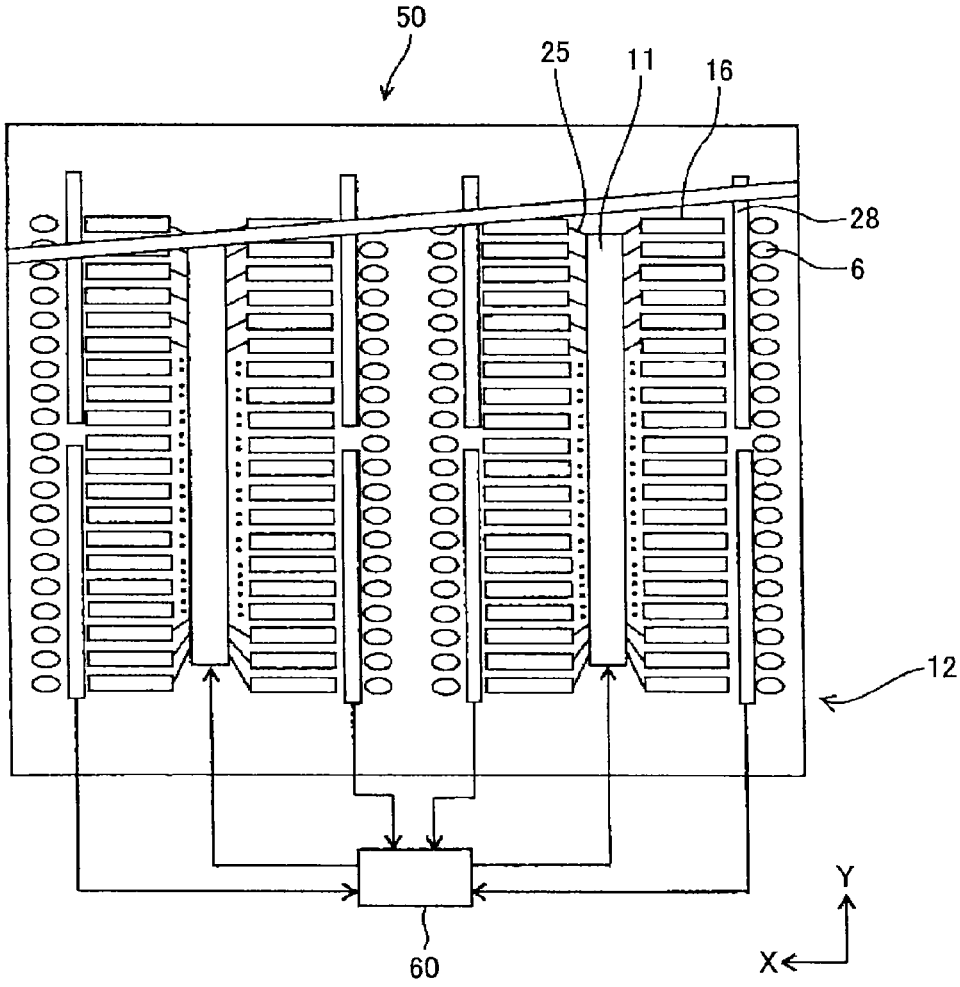
FIG. 6 is a top view of the lower layer of the liquid droplet ejecting head, two of which are aligned in a direction in which the temperature-measuring resistive body extends.

FIG. 6 is a planar view of the lower layer of the liquid droplet ejecting head 50, two of which are arranged such that they are aligned in a direction in which the temperature measuring resistive body 28 extends. At the dedicated liquid chamber substrate 12 shown in FIG. 6, two of the temperature measuring resistive bodies 28 extending along a pressure chamber column are arranged such that they are aligned in their extending direction. As the temperature measuring resistive bodies 28 are arranged such that they are divided within the same column, a driving voltage to be applied to the piezoelectric element 16 by the driving IC 11 may be selected more precisely according to the temperature distribution in the Y direction, making it possible to stabilize the ejection characteristics.

Moreover, as shown in FIG. 5B, the liquid droplet ejecting head 50 is provided with a liquid supplying substrate 7 on which is provided a common liquid chamber 8, which is a supplying liquid container which contains ejecting liquid such as ink, etc., to be supplied to the pressure chamber 3. The liquid supplying substrate 7 is fixed to and overlaid onto a face opposite a face to which a nozzle substrate 1 at the dedicated liquid chamber substrate 12 is fixed, and a temperature measuring resistive body 28 is arranged at a joint portion between an upper face of the dedicated liquid chamber substrate 12 and the liquid supplying substrate 7. Such an arrangement includes the temperature measuring resistive body 28 arranged at the joint portion between the dedicated liquid chamber substrate 12 and the liquid supplying substrate 7 as a feature which is always found from a configuration standpoint, so that there is no need to provide a special space for arranging the temperature resistive body 28, making it possible to avoid the size of the liquid droplet ejecting head 50 from becoming large and to achieve low cost.

(Manufacturing Methods)

The manufacturing process of the liquid ejecting head 50 according to the present embodiment is shown in (a) to (l) below:

(a) A silicon nitride film as a mask is patterned at a location other than a location at which the vibrating plate 17 on the dedicated liquid chamber substrate 12 is provided. Thereafter, using a silicon thermal oxide film forming method (e.g., a plasma CVD method, a pyrooxidation method), the vibrating plate 17, which is a multilayer lamination film of polysilicon and $SiO_2$, is formed on the dedicated liquid chamber substrate 12.

(b) Using a solgel method or a sputtering method as a thin film forming method, a layer to be the temperature measuring resistive body 28 and a common electrode 13 which includes Pt, Ti, LNO, and SRO, for example, is formed on an upper face of the dedicated liquid chamber substrate 12 on which the vibrating plate 17 is formed. Moreover, a layer of the piezoelectric material 14 which includes PZT, for example, and a layer of an upper electrode 15, which includes Pt, LNO, and SRO, for example, are formed successively.

(c) Using the photolithographic method, the upper electrode 15; the piezoelectric material 14; the common electrode 13; and the temperature measuring resistive body 28 are successively patterned, forming the piezoelectric element 16 and the temperature measuring resistive body 28.

While a shape of the temperature measuring resistive body 28 formed then may be as shown in FIGS. 5 and 6, for example, it is not so limited.

(d) The interlayer insulating film 24 which includes $SiO_2$ and SiN, for example, is formed at the common electrode 13 and an end of the piezoelectric element 16, avoiding a portion over the upper electrode 15 so as not to hinder a vibrating displacement after forming, for preventing discharging of the piezoelectric element 16, the insulating film 23 (e.g., $Al_2O_3$) to cover the piezoelectric element 16.

(e) The lead wire 25 which includes aluminum is formed at a desired location.

(f) The liquid supplying substrate 7, which is manufactured separately by forming a concave section 26 on a silicon substrate by a lithographic etching method, is glued to a piezoelectric element face of the dedicated liquid chamber substrate 12.

(g) The opposite side of the piezoelectric forming face of the dedicated liquid chamber substrate 12 is polished to a desired thickness.

(h) The opposite side of the piezoelectric element forming face of the dedicated liquid substrate 12 is etched by ICP dry etching, thereby forming a concave section to be the ink introducing channel 5, the fluid resistance section 4, and the pressure chamber 3 as a dedicated liquid chamber.

The nozzle substrate 1, at which the nozzle holes 2 are formed separately by an SUS pressing process and polishing, is joined on the concave section forming side of the dedicated liquid chamber substrate 12.

(i) The driving IC 11, which is manufactured separately at the bump 10 which is provided on the liquid supplying substrate 7 of the dedicated liquid chamber substrate 12, is mounted by flip chip joining.

(j) A liquid contact film is formed on the frame substrate 9 manufactured by separately joining the first frame layer 9*a*, the second frame layer 9*b*, and the third frame layer 9*c* that are formed by a pressing process and a fine cutting process, after which it is joined to the liquid supplying substrate 7.

(k) The reinforcing plate 20 which is provided with the damper film 19 is joined to the frame substrate 9.

(l) A housing (not shown) which is separately manufactured is joined onto the reinforcing plate 20.

The liquid ejecting head 50 according to the present embodiment is completed by the above described process of (a) to (l).

According to the liquid droplet ejecting head 50 of the present embodiment, the temperature measuring resistive body 28 is of the same material as the common electrode 13. Then, at the time of manufacturing, as in the above-described process of (b), a layer to be the temperature measuring resistive body 28 and the common electrode 13 is formed as one layer, and two types of members of the common electrode 13 and the temperature measuring resistive body 28 are formed by patterning as in the above-described process in (c).

In this way, the temperature measuring resistive body 28 is formed of the same material as the upper electrode or the common electrode, and the electrode and the temperature measuring resistive body 28 are simultaneously formed, making it possible to form the temperature measuring resistive body 28 without increasing the processes and without providing a special material. In this way, while a stable image quality is maintained by temperature detection by the temperature measuring resistive body 28, there is no factor which leads to an increase in cost, making it possible to achieve low cost.

Moreover, the piezoelectric element 16, which is a resistive body, may generate heat due to Joule heat by voltage application due to deforming. Therefore, when an ejecting liquid chamber forming member at which a piezoelectric element is arranged and which forms an ejecting liquid chamber and a member at which the temperature measuring resistive body is arranged are different members, a temperature difference occurs between a temperature of a location at which the temperature measuring resistive body is arranged and a temperature of ink within the ejecting liquid chamber, causing a change in an amount of liquid droplets ejected, making it not possible to obtain stable ink liquid droplet ejecting characteristics.

On the other hand, according to the liquid droplet ejecting head 50 of the present embodiment, as the temperature measuring resistive body 28 is arranged at the dedicated liquid chamber 12, which is an ejection liquid chamber forming member which forms the pressure chamber 3, which is an ejecting liquid chamber, and at which the piezoelectric element 16 is arranged, even when temperature of the dedicated liquid chamber substrate 12 increases due to Joule heat of the piezoelectric element 16, the temperature increase is also reflected into a location at which the temperature measuring resistive body 28 is arranged, so that it is unlikely for the temperature difference to occur between the temperature of a location at which the temperature measuring resistive body 28 is arranged and the temperature of ink within the pressure chamber 3, making it possible to eject a stable ink liquid droplet amount.

As such the liquid droplet ejecting head 50 is used for the recording head 51, in the printer 100 of the present embodiment, even when the temperature of the installed environment changes, a stable ink liquid droplet ejecting characteristic is obtained, so that image quality is improved.

Moreover, while, in the above-described embodiment, an example is described in which the liquid droplet ejecting head 50 is applied as the recording head 51 of an inkjet printer, the above-described embodiment may also be applied to other liquid droplet ejecting heads such as a liquid droplet head which ejects a liquid resist as liquid droplets; and a liquid droplet ejecting head which ejects a DNA sample as liquid droplets, for example, as the liquid droplet ejecting head 50 other than the inkjet head.

What are described in the above are exemplary, so that the present invention effects advantages for each of the following modes:

(Mode A)

A liquid droplet ejecting head such as a liquid droplet ejecting head 50 is configured by overlaying and fixing a nozzle plate such as a nozzle substrate 1 that is provided with a nozzle hole such as a nozzle hole 2 that ejects liquid droplets; an ejecting liquid chamber forming member such as a dedicated liquid chamber substrate 12 which makes up a wall face forming an ejecting liquid chamber, the liquid droplet ejecting head including the nozzle hole; an ejecting liquid chamber such as a pressure chamber 3 that is in communication with outside via the nozzle hole and that contains an ejecting liquid such as ink to be liquid droplets; a pressure generating unit such as a piezoelectric element 16 that generates pressure within the ejecting liquid chamber; a temperature detecting unit such as a controller 60 that detects temperature at a location at which is arranged a temperature measuring resistive body such as a temperature measuring resistive body 28; and a pressure control unit such as a driving IC 11 that controls an output of the pressure generating unit based on detected results of the temperature detecting unit. The pressure generating unit increases pressure within the ejecting liquid chamber, so that the ejecting liquid within the ejecting liquid chamber is ejected from the nozzle hole as the liquid droplets, the temperature measuring resistive body such as the temperature measuring resistive body 28 is arranged at the ejecting liquid chamber forming member such as the dedicated liquid chamber substrate 12. According to the present mode, as described for the above embodiment, the temperature measuring resistive body 28 is arranged on the dedicated liquid chamber substrate 12, making it possible to accurately sense a temperature of a location proximate to ink for ejecting, to supply an appropriate voltage to the piezoelectric element 16, and to stabilize the ejecting characteristic.

(Mode B)

In (Mode A), the pressure generating unit includes a vibrating plate such as a vibrating plate 17 that makes up a part of the wall face of the ejecting liquid chamber such as a pressure chamber 3 and that changes a volume of the ejecting liquid chamber by deforming; a piezoelectric element such as a piezoelectric element 16, wherein one (a common electrode 13) of two electrodes such as the common electrode and an upper electrode that place a piezoelectric material such as a piezoelectric material 14 therebetween is integrally formed with the vibrating plate, a voltage is applied between the two electrodes, so that deforming occurs in the piezoelectric material and the deforming is transmitted to deform the vibrating plate; and a driving power supply such as a driving IC 11 that applies a voltage to the piezoelectric element, pressure within the ejecting liquid chamber is generated by a change in a volume of the ejecting liquid chamber due to deforming of the vibrating plate, and the pressure control unit controls a voltage applied to the piezoelectric element such as the piezoelectric element 16 by a driving power supply such as a driving IC 11 to control an amount of deforming of the piezoelectric material and the vibrating plate and to control the magnitude of pressure within the ejecting liquid chamber that is produced due to deforming of the vibrating plate. As described for the above embodiment, the present mode makes it possible to realize a configuration in which ejecting pressure needed at the respective temperatures is output by the piezoelectric element 16 in response to a temperature change of ink within the pressure chamber 3.

(Mode C)

In (Mode A) or (Mode B), the ejecting liquid chamber forming member such as the dedicated liquid chamber substrate 12 is a configuration in which an ejecting liquid chamber such as multiple pressure chambers 3 are aligned in a straight line shape (in a Y-axis direction) to form an ejecting liquid chamber column as a column of the ejecting liquid chamber, and at a nozzle plate such as a nozzle substrate 1 are provided nozzle holes such as multiple nozzle holes 2 to form the nozzle plate, the nozzle holes corresponding to the respective multiple ejecting liquid chambers provided at the ejecting liquid chamber forming member when the ejecting liquid chamber forming member is fixed, and the temperature measuring resistive body such as the temperature measuring resistive body 28 is arranged such that it extends along the ejecting liquid chamber column. As described for the present embodiment, according to the present mode, when there is temperature distribution for each ejecting liquid chamber column such as the pressure chamber 3, and determining an accurate temperature is difficult, the temperature measuring resistive bodies such as the temperature measuring resistive bodies 28 are aligned along the ejecting liquid chamber column, making it possible to measure the average temperature, to efficiently select the driving temperature, and to stabilize the ejecting performance.

(Mode D)

In (Mode C), the ejecting liquid chamber forming member such as the dedicated liquid chamber substrate 12 includes multiple columns of ejecting liquid chambers such as multiple pressure chambers 3, and includes temperature measuring resistive bodies such as multiple temperature measuring resistive bodies 28 that correspond to the respective multiple ejecting liquid chamber columns. As described for the above embodiment, according to the present mode, the temperature measuring resistive body is arranged in each column of a dedicated liquid chamber column or a nozzle column, making it possible to select a driving voltage for each column according to the temperature distribution and to stabilize the ejecting characteristic.

(Mode E)

In (Mode C) or (Mode D), temperature measuring resistive bodies such as temperature measuring resistive bodies 28 that are arranged such that they extends along an ejecting liquid chamber column such as a pressure chamber column are arranged such that they are aligned in multiple numbers in an extending direction thereof. As described for the above embodiment using FIG. 6, according to the present mode, the temperature measuring resistive bodies are arranged such that they are divided within the same column, making it possible to more precisely select the driving voltage and to stabilize the ejecting characteristics.

(Mode F)

In any one mode of (Mode A) to (Mode E) is provided an ejecting liquid supplying unit forming member such as a liquid supplying substrate 7 that is fixed by overlaying onto a face on the side opposite a face onto which a nozzle plate such as a nozzle plate 1 at an ejecting liquid chamber forming member such as a dedicated liquid chamber substrate 12 and that is formed with a common liquid chamber 8 which is a supplying liquid container which contains ejecting liquid such as ink that is supplied to the ejecting liquid chamber such as the pressure chamber 3, and a temperature measuring resistive body such as a temperature measuring resistive body 28 is arranged at a joint portion between the ejecting liquid chamber forming member and the ejecting liquid supplying section forming member. As described for the above embodiment, according to the present mode, as the temperature measuring resistive body is arranged at the joint portion between the dedicated liquid chamber substrate and the ejecting liquid supplying section forming member as a feature which is always found from a configuration standpoint, there is no need to provide a special space for arranging a temperature measuring resistive body, making it possible to avoid the droplet ejecting head from becoming large and to achieve low cost.

(Mode G)

In (Mode B) or any one of (Mode C) through (Mode F), the temperature detecting unit such as a controller 60 includes a correcting circuit which precisely measures temperature, a pressure control unit such as a driving IC 11 includes an A/D converting circuit which digitizes an electrical signal output from the correcting circuit by A/D conversion, and the correcting circuit and the A/D converting circuit are formed on the same substrate (such as the dedicated liquid chamber substrate 12) as the driving power supply such as the driving IC 11. As described for the above embodiment, according to the present mode, as the correcting circuit and the A/D converting circuit are installed in the driving IC 11, signal transmission beyond the A/D converting circuit becomes a digital signal, so that measurement accuracy of temperature is not undermined no matter how long the wire becomes, making it possible to stabilize the ejection characteristics as a result.

(Mode H)

In an ink cartridge such as an ink cartridge 102 that has integrated therein an ink ejecting head which ejects ink droplets and an ink tank such as a tank 102*a* that supplies ink to the ink ejecting head such as the recording head 51, a liquid droplet ejecting head of any one mode of (Mode A) to (Mode G) is used as an ink ejecting head. As described for the above embodiment, the present mode makes it possible to replace one integrated body of an ink tank such as a tank 102*a*; and a liquid droplet ejecting head from an image forming apparatus such as the printer 100, so that replaceability of the liquid droplet ejecting head which may stabilize the ejecting characteristic is improved.

(Mode I)

In an inkjet recording apparatus such as a printer 100 that has installed therein an inkjet head such as a recording head 51 which ejects ink liquid droplets, a liquid droplet ejecting head of any one mode of (Mode A) through (Mode G) is used as an inkjet head. As described for the above embodiment, the present mode makes it possible to stabilize the ejecting characteristics even when the ambient temperature changes, making it possible to maintain the stable image quality.

(Mode J)

In an inkjet recording apparatus such as a printer 100 that causes liquid droplets to be ejected from a head such as a recording head 51 of an ink cartridge such as an ink cartridge 102 to record onto a medium to be recorded such as a sheet 30, an ink cartridge of (Mode H) is provided as an ink cartridge. As described above for the above embodiment, as the ejecting characteristics may be stabilized even when the ambient temperature changes, the present mode makes it possible to maintain a stable image quality and, moreover, the replaceability of the liquid droplet ejecting head which may stabilize the ejecting characteristics is improved.

The present application is based on Japanese Priority Application No. 2011-155959 filed on Jul. 14, 2011, the entire contents of which are hereby incorporated by reference.

The invention claimed is:

1. A liquid droplet ejecting head which is configured by overlaying and fixing a nozzle plate which is provided with a nozzle hole; and an ejecting liquid chamber forming member which makes up a wall face forming an ejecting liquid chamber, the liquid droplet ejecting head comprising:

the nozzle hole which ejects liquid droplets;

an ejecting liquid chamber which is in communication with outside via the nozzle hole and which contains an ejecting liquid to be the liquid droplets;

a pressure generating unit which generates pressure within the ejecting liquid chamber, the pressure generating unit including:

a vibrating plate which forms a part of a wall face of the ejecting liquid chamber and which changes a volume of the ejecting liquid chamber by deforming; and a piezoelectric element including a piezoelectric material and first and second electrodes having the piezoelectric material therebetween, wherein applying a voltage between the first and second electrodes causes the deforming to occur in the piezoelectric material and the deforming is transmitted to deform the vibrating plate;

a temperature detecting unit which detects temperature at a location at which is arranged a temperature measuring resistive body, the temperature measuring resistive body being formed in a same layer as a layer in which is formed the first electrode, the first electrode being located on an ejecting liquid chamber side; and a pressure control unit which controls an output of the pressure generating unit based on detected results of the temperature detecting unit, wherein the pressure generating unit is configured to increase the pressure within the ejecting liquid chamber, so that the ejecting liquid within the ejecting liquid chamber is ejected from the nozzle hole as the liquid droplets, and wherein the temperature measuring resistive body is arranged at the ejecting liquid chamber forming member, an ejecting liquid supplying unit forming member which is fixed by being overlaid onto a face on the side opposite a face onto which the nozzle plate at the ejecting liquid chamber forming member is fixed and which is formed with a supplying liquid container which contains the ejecting liquid which is supplied to the ejecting liquid chamber, wherein a concave portion is formed in the ejecting liquid supplying unit forming member such that the ejecting liquid chamber side of the ejecting liquid supplying unit forming member opens, wherein the piezoelectric element is accommodated between the concave portion and the vibrating plate, wherein a convex face of the concave portion that protrudes to the ejecting liquid chamber relative to a bottom face of the concave portion is fixed by being overlaid onto a face on the side opposite a face onto which the nozzle plate at the ejecting liquid chamber forming member is fixed, and wherein the temperature measuring resistive body is arranged at a joint portion between the ejecting liquid chamber forming member and the convex face of the concave portion.

2. The liquid droplet ejecting head as claimed in claim 1, wherein one of the first and second electrodes is integrally formed with the vibrating plate, wherein the pressure generating unit includes a driving power supply which applies a voltage to the piezoelectric element, wherein pressure within the ejecting liquid chamber is generated by a change in a volume of the ejecting liquid chamber due to deforming of the vibrating plate, and wherein the pressure control unit controls the voltage applied to the piezoelectric element by the driving power supply to control an amount of deforming of the piezoelectric material and the vibrating plate and to control the magnitude of pressure within the ejecting liquid chamber that is produced due to deforming of the vibrating plate.

3. The liquid droplet ejecting head as claimed in claim 2, wherein the temperature detecting unit includes a correcting circuit which precisely measures temperature, wherein the pressure control unit includes an A/D converting circuit which digitizes an electrical signal output from the correcting circuit by A/D conversion, and wherein the correcting circuit and the A/D converting circuit are formed on the same substrate as the driving power supply.

4. The liquid droplet ejecting head as claimed in claim 1, wherein the ejecting liquid chamber forming member is configured such that multiple of the ejecting liquid chambers are aligned in a straight line shape to form an ejecting liquid chamber column as a column of the ejecting liquid chambers, wherein at the nozzle plate are provided multiple of the nozzle holes formed in the nozzle plate, the nozzle holes corresponding to the respective multiple ejecting liquid chambers provided at the ejecting liquid chamber forming member when the ejecting liquid chamber forming member is fixed, and wherein the temperature measuring resistive body is arranged such that it extends along the ejecting liquid chamber column.

5. The liquid droplet ejecting head as claimed in claim 4, wherein the ejecting liquid chamber forming member includes multiple of the columns of the ejecting liquid chambers, and wherein multiple of the temperature measuring resistive bodies are included which correspond to the multiple ejecting liquid chamber columns.

6. The liquid droplet ejecting head as claimed in claim 4, wherein multiple of the temperature measuring resistive bodies are arranged in the extending direction thereof.

7. An ink cartridge which has integrated therein an ink ejecting head which ejects ink droplets and an ink tank which supplies ink to the ink ejecting head, wherein the liquid droplet ejecting head as claimed in claim 1 is used as the ink ejecting head.

8. An inkjet recording apparatus which causes liquid droplets to be ejected from a head of an ink cartridge to record onto a recording medium, wherein the ink cartridge as claimed in claim 7 is used as the ink cartridge.

9. An inkjet recording apparatus which has installed therein an inkjet head which ejects ink liquid droplets, wherein the liquid droplet ejecting head as claimed in claim 1 is used the inkjet head.

* * * * *